US008089452B2

(12) United States Patent
Kawai

(10) Patent No.: US 8,089,452 B2
(45) Date of Patent: Jan. 3, 2012

(54) ELECTROPHORESIS DEVICE, ELECTRONIC APPARATUS, AND DRIVING METHOD OF ELECTROPHORESIS DEVICE

(75) Inventor: Hideyuki Kawai, Fujimi (JP)

(73) Assignee: Seiko Epson Corporation (JP)

( * ) Notice: Subject to any disclaimer, the term of this patent is extended or adjusted under 35 U.S.C. 154(b) by 1162 days.

(21) Appl. No.: 11/467,647

(22) Filed: Aug. 28, 2006

(65) Prior Publication Data

US 2007/0063965 A1 Mar. 22, 2007

(30) Foreign Application Priority Data

Sep. 22, 2005 (JP) ..... 2005-276543

(51) Int. Cl.
*G09G 3/34* (2006.01)

(52) U.S. Cl. ..... 345/107

(58) Field of Classification Search ..... 345/107, 345/104, 211, 87
See application file for complete search history.

(56) References Cited

U.S. PATENT DOCUMENTS

| | | | | |
|---|---|---|---|---|
| 5,392,058 | A * | 2/1995 | Tagawa | 345/104 |
| 5,495,353 | A * | 2/1996 | Yamazaki et al. | 349/43 |
| 6,680,517 | B2 * | 1/2004 | Namba | 257/499 |
| 6,724,521 | B2 * | 4/2004 | Nakao et al. | 359/296 |
| 7,259,745 | B2 * | 8/2007 | Hamaguchi | 345/107 |
| 2003/0053281 | A1 * | 3/2003 | Takeuchi et al. | 361/160 |
| 2004/0263701 | A1 | 12/2004 | Ukigaya | |
| 2005/0041004 | A1 * | 2/2005 | Gates et al. | 345/87 |
| 2006/0181504 | A1 | 8/2006 | Kawai | |

FOREIGN PATENT DOCUMENTS

| | | |
|---|---|---|
| JP | 52-070791 | 6/1977 |
| JP | 2000-321605 | 11/2000 |
| JP | 2004-325489 | 11/2004 |
| WO | 03-044765 | 5/2003 |

* cited by examiner

*Primary Examiner* — Quan-Zhen Wang
*Assistant Examiner* — Tony Davis
(74) *Attorney, Agent, or Firm* — Harness, Dickey & Pierce, P.L.C.

(57) ABSTRACT

An electrophoresis device includes a first substrate having a plurality of pixel electrodes formed on a surface thereof, a second substrate having a common electrode formed on a surface thereof and disposed to face the pixel electrodes, and an electrophoretic layer disposed between the pixel electrodes and the common electrode. The electrophoresis device makes electrophoretic particles migrate by keeping the potential of each pixel electrode constant and changing a voltage to be applied to the common electrode. The device also includes a voltage control means which supplies a voltage whose minimum voltage is not less than V3 and whose maximum voltage are not more than V4 to the common electrode, in a case where a potential which appears in each pixel electrode when a minimum voltage V1 is supplied to a voltage supply means to each pixel electrode is set to V3 and a potential which appears in each pixel electrode when a maximum voltage V2 is supplied to the voltage supply means is set to V4.

6 Claims, 4 Drawing Sheets

ELECTROPHORESIS DEVICE, ELECTRONIC APPARATUS, AND DRIVING METHOD OF ELECTROPHORESIS DEVICE

BACKGROUND

1. Technical Field

The present invention relates to an electrophoresis device, an electronic apparatus, and a driving method of the electrophoresis device.

2. Related Art

An electrophoresis device is constructed by sealing an electrophoretic dispersion liquid containing one or more kinds of electrophoretic particles and an electrophoretic dispersion medium between a set of opposed electrode plates at least one of which is transparent. By applying a voltage between two electrodes, the electrophoretic particles move in the electrophoretic dispersion medium and the distribution thereof change accordingly. This changes optical reflection characteristics, enabling display of information.

In the electrophoresis device, it is necessary to apply a bipolar voltage between the two electrodes in order to move the electrophoretic particles reversibly, However, a transistor used for driving of the electrophoresis device has unipolarity.

As a technique for solving this problem, there is a technique disclosed in, for example, JP-A-52-70791. According to this technique, in an electrophoretic display panel, the potential of a pixel electrode divided into a plurality of segment electrodes is maintained at either of two different potentials V1 and V2 (V1<V2), and a pulse voltage which varies between V1 and V2 is applied to an opposed common electrode.

Thereby, when the potential of the common electrode is V2, an electric field is generated from the common electrode toward the pixel electrode in a region of the pixel electrode of potential V1, while an electric field is not generated in a region of the pixel electrode of potential V2. Therefore, if the electrophoretic particles are positively charged, the electrophoretic particles will migrate toward the direction of the pixel electrode in the region of the pixel electrode of potential V1, and the particles will not migrate in the region of the pixel electrode of potential V2. On the contrary, when the potential of the common electrode is V1, an electric field is generated from the pixel electrode toward the common electrode in the region of the pixel electrode of potential V2, while an electric field is not generated in a region of the pixel electrode of potential V1. Therefore, positively charged electrophoretic particles migrate toward the direction of the common electrode in the region of the pixel electrode of potential V2, and any particles do not migrate in the region of the pixel electrode of potential V1.

By changing the potential of the common electrode at least one or more cycles between V1 and V2 in this way, the electrophoretic particles can move alternately in the region of each pixel electrode, and consequently the electrophoretic particles of each region can be migrated toward a desired direction. According to this method, since the voltages applied to the common electrode are only V1 and V2, it is also possible to use a unipolar transistor.

However, the above method has a problem in that, since the voltage to be applied to the pixel electrode shifts due to factors, such as a voltage drop by wiring resistance and leak, display may be disturbed. That is, not only V1 and V2 but also the potentials V3 and V4 shifted from V1 and V2 under the influence of wiring resistance, wiring capacity, and leak, appear actually in a pixel electrode. Here, a case in which V3 is slightly higher than V1 and V4 is slightly lower than V2 will be described. Since wiring lines on the side of the pixel electrodes generally are formed as minutely as possible in order to increase the density of pixels, a voltage drop by wiring resistance and the voltage shifting by leak are apt to occur. On the other hand, since wiring lines on the side of the common electrode is relatively sparse and thick wiring lines are allowed, a voltage drop by wiring resistance and voltage shifting by leak occur hardly.

In this case, when the potential of the common electrode is V2, the relationship V3<V2 is established in the region of the pixel electrode 13*a*-1 of potential V3. Therefore an electric field is generated in the direction of the pixel electrode, and if electrophoretic particles are charged positively, the electrophoretic particles migrate toward the direction of the pixel electrode On the other hand, since the relationship V4<V2 is established also in the region of the pixel electrode of potential V4, an electric field, though slight, may be generated in the direction of the pixel electrode, Further, when the potential of the common electrode is V1, the relationship V4>V1 is established in the region of the pixel electrode of potential V4. Therefore, an electric field is generated in the direction of the common electrode, and electrophoretic particles which are charged positively migrate toward the direction of the common electrode. On the other hand, since the relationship V3>V1 is established also in the region of the pixel electrode having potential V4, an electric field, though slight, may be generated in the direction of the common electrode. Since the electrophoresis device does not have threshold characteristics, the electrophoretic particles may migrate also in response to such slight electric field, which causes deterioration of display quality.

SUMMARY

An advantage of the invention is that it provides to prevent deterioration of the display quality under the influence of a voltage drop of a pixel electrode in an electrophoresis device which makes electrophoretic particles migrate by keeping the voltage of the pixel electrode constant to change the voltage of a common electrode.

According to an aspect of the invention, an electrophoresis device includes a first substrate having a plurality of pixel electrodes formed on a surface thereof, a second substrate having a common electrode formed on a surface thereof and disposed to face the pixel electrodes, and an electrophoretic layer disposed between the pixel electrodes and the common electrode. The electrophoresis device makes electrophoretic particles migrate by keeping the potential of each pixel electrode constant and changing a voltage to be applied to the common electrode. The device also includes a voltage control means which supplies a voltage whose minimum voltage is not less than V3 and whose maximum voltage are not more than V4 to the common electrode, in a case where a potential which appears in each pixel electrode when a minimum voltage V1 is supplied to a voltage supply means to each pixel electrode is set to V3 and a potential which appears in each pixel electrode when a maximum voltage V2 is supplied to the voltage supply means is set to V4.

Further, the first substrate may further include a thin film semiconductor circuitry layer.

As a result, it is possible to prevent deterioration of display quality which may be caused by migration of electrophoretic particles as the potential of a pixel electrode shifts by wiring resistance, etc.

Further, according to still another aspect of the invention an electronic apparatus includes the above-described electrophoresis device as a display unit. Here, the "electronic apparatus" includes all apparatuses provided with a display unit using the display by an electrophoretic material, and more specifically, includes display apparatuses, TV apparatuses, electronic papers, clocks, electronic calculators, portable telephones, personal digital assistants (PDAs), etc. Further, the concept of the "apparatus" also include, arbitrary things, for example, flexible sheet-like or film-like objects, things belonging to real estate, such as wall surfaces to which these objects are bonded, and things belonging to movable bodies, such vehicles, flying bodies, and vessels.

According to another aspect of the invention, there is provided a method of an electrophoresis device including a first substrate having a plurality of pixel electrodes formed on a surface thereof, a second substrate having a common electrode formed on a surface thereof and disposed to face the pixel electrodes, and an electrophoretic layer disposed between the pixel electrodes and the common electrode. The electrophoresis device makes electrophoretic particles migrate by keeping the potential of each pixel electrode constant and changing a voltage to be applied to the common electrode. The method includes supplying a voltage whose minimum voltage is not less than V3 and whose maximum voltage are not more than V4 to the common electrode, in a case where a potential which appears in each pixel electrode when a minimum voltage V1 is supplied to a voltage supply means to each pixel electrode is set to V3 and a potential which appears in each pixel electrode when a maximum voltage V2 is supplied to the voltage supply means is set to V4.

As a result, it is possible to prevent deterioration of display quality which may be caused by migration of electrophoretic particles as the potential of a pixel electrode shifts by wiring resistance, etc.

In addition, it is preferable that a pulse voltage of 50% duty ratio be applied to the common electrode. This allows uniform application of voltage, which makes it possible to prevent deterioration of display unevenness and dispersion liquid.

Further, it is desirable that a voltage to be applied to the common electrode is changed at a pulse period of 50 to 1000 milliseconds. This is because electrophoretic particles cannot have sufficient responsiveness if the pulse period is not more than 50 ms, and display switching time become too long if the pulse period is not less than 1000 ms.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

Embodiment 1

Figure 1:
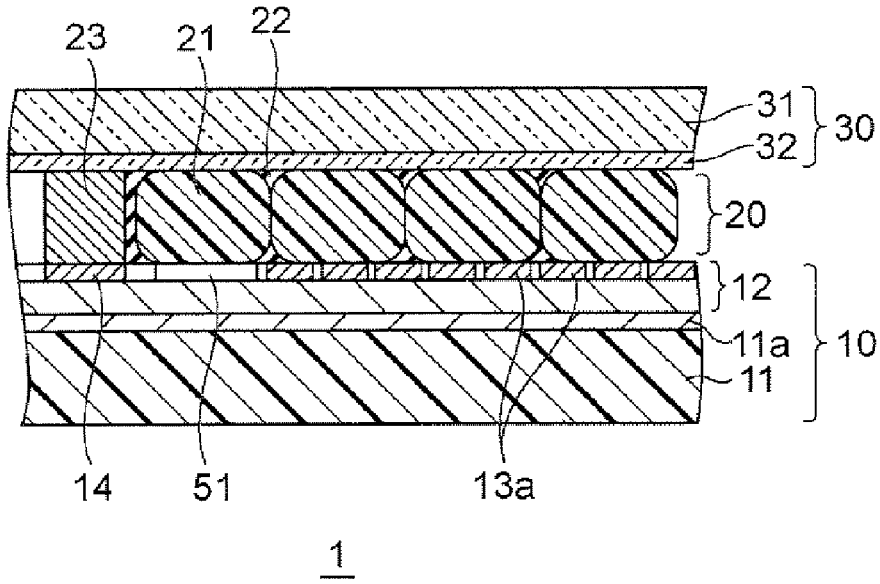
FIG. 1 is a view showing the section of an electrophoresis device according to the invention.

FIG. 1 is a view showing the section of an electrophoresis display device 1 that is an example of the electrophoresis device according to the invention. As shown in this figure, the electrophoresis display device 1 is roughly composed of a first substrate 10, an electrophoretic layer 20, and a second substrate 30.

In the first substrate 10, a thin film semiconductor circuitry layer 12 is formed on a flexible substrate 11 as an insulating underlying substrate which forms an electric circuit. The thickness of the first substrate 10, for example, is desirably 25 μm or more from the viewpoint of the physical strength of the substrate in forming a thin film circuit, and it is desirably 200 μm or less from the viewpoint of flexibility of the substrate.

The flexible substrate 11 is, for example, a polycarbonate substrate having a film thickness of 200 μm. On this flexible substrate 11, a semiconductor circuit layer 12 is laminated (bonded) via an adhesive layer 11*a* made of, for example, a UV (ultraviolet rays) curable adhesive. As the flexible substrate 11, resin materials having excellent properties, such as light weight, flexibility, elasticity, etc. can be used.

The thin film semiconductor circuitry layer 12 includes, for example, a plurality of wiring groups which are arranged in a row direction and in a column direction, respectively, a pixel electrode group, a pixel driving circuit, connecting terminals, and a row decoder 51 and a column decoder (not shown), which select driving pixels, etc. The pixel driving circuit includes circuit elements, such as thin-film transistors (TFTs).

The pixel electrode group contains a plurality of pixel electrodes 13*a* arranged in a matrix, and forms an image (two-dimensional information) display region. An active matrix circuit is formed so that an individual voltage can be applied to each pixel electrodes 13*a*.

A connection electrode 14 is formed at the peripheral portion of the thin film semiconductor circuitry layer 12 to electrically connect a transparent electrode layer 32 of the second substrate 30 to circuit wiring of the first substrate 10.

The electrophoretic layer 20 is formed on the pixel electrodes 13*a* and over their periphery region. The electrophoretic layer 20 includes a large number of microcapsules 21 fixed with a binder 22. An electrophoretic dispersion medium and electrophoretic particles are contained in the microcapsules 21. The electrophoretic particles have a property of moving in the electrophoretic dispersion medium according to an applied voltage, and one or more types of the electrophoretic particles are used. The thickness of the electrophoretic layer 20 is, for example, about 30 μm to 75 μm. The electrophoretic layer 20 can be formed by mixing the above-mentioned microcapsules 21 along with a desired dielectric constant moderator in the binder 22, and coating the resulting resin composition (emulsion or organic solvent solution) on a base material by using known coating methods, such as a method using a roll coater, a method using a roll laminator, a screen printing method, and a spray method. Moreover, in order to surely bring the microcapsules 21 into close contact with the pixel electrodes 13*a*, an adhesive may be included in the electrophoretic layer 20.

Here, as the electrophoretic dispersion medium, a single one of or a mixture of the following materials to which a surfactant and so on is added may be used: water; alcohol solvents such as methanol, ethanol, isopropanol, butanol, octanol and methyl cellosolve; esters such as ethyl acetate and butyl acetate; ketones such as acetone, methyl ethyl ketone and methyl isobutyl ketone; aliphatic hydrocarbons such as pentane, hexane and octane; alicyclic hydrocarbons such as cyclohexane and methylcyclohexane; aromatic hydrocarbons such as benzene, toluene, xylene, hexylbenzene; halogenated hydrocarbons such as methylene chloride, chloroform, carbon tetrachloride and 1,2-dichloroethane; carboxylates; and other various oils.

The electrophoretic particles, as mentioned above, are particles (polymers or colloids) having the property of moving toward a desired electrode based on electrophoresis by a potential difference in the electrophoretic dispersion medium. As the electrophoretic particles, for example, there are black pigments such as aniline black and carbon black; white pigments such as titanium dioxide, zinc oxide and antimony trioxide; azo-based pigments such as monoazo, dis-azo, and polyazo; yellow pigments such as isoindolenone, chrome yellow, yellow iron oxide, cadmium yellow, titanium yellow, and antimony; red pigments such as quinacrilidone red and chrome vermillion; anthraquinone-based dyes such as phthalocyanine blue and indanthrene blue; blue pigments such as prussian blue and ultramarine blue, cobalt blue, etc.; and green pigments such as phthalocyanine green. One of or a plurality of the above types of pigment particles may be used. Moreover, if necessary, the following agents can be added to these pigments: a charge controlling agent made of particles of an electrolyte, surfactant, metal soap, resin, rubber, oil, varnish, compound or the like; a dispersing agent such as a titanium coupling agent; a lubricating agent; a stabilizing agent; and so forth.

As the materials constituting the microcapsules 21, materials having flexibility, such as Arabic-gum/gelatin-based compounds and urethane-based compounds are preferably used. The microcapsules 21 can be formed using known microencapsulation techniques, such as an interfacial polymerization method, an insolubilization reaction method, a phase separation method or an interfacial sedimentation method. Further, the microcapsules 21 whose sizes are substantially uniform are preferable since they allow an excellent display function to be exhibited. The microcapsules 21 whose sizes are substantially uniform can be obtained by using, for example, filtration or specific gravity difference classification. The size of the microcapsules is generally about 30 to 60 μm.

The binder 22 is not particularly limited so long as it has a good affinity to the microcapsules 21, an excellent adhesiveness to the electrodes, and insulation property.

The second substrate 30 is made of a thin film (transparent insulating synthetic resin base material) 31 having the transparent electrode layer (common electrode) 32 formed on the bottom face thereof, and is formed so as to cover the top of the electrophoretic layer 20. The thickness of the first substrate 30 is desirably 10 to 200 μm, and more preferably 25 to 75 μm.

A thin film 31 seals and protects the electrophoretic layer 20, and is formed using, for example, a polyethylene terephthalate (PET) film. Similar to the above-described flexible substrate 11, various materials can be used as the thin film 31 if only they are insulating transparent materials. It is favorable that the thickness of the thin film 31 is not more than the thickness of the flexible substrate 11. More preferably, the thickness of the thin film is about half or less the thickness of the flexible substrate 11.

The transparent electrode layer 32 is formed using, for example, a transparent conductive film, such as indium oxide film (ITO film) doped with tin. The circuit wiring of the first substrate 10 and the transparent electrode layer 32 of the second substrate 30 are connected on the outside of a region where the electrophoretic layer 20 is formed Specifically, the transparent electrode layer 32 and the connection electrode 14 of the thin film semiconductor circuitry layer 12 are connected to each other via a conductive connector 23.

As the transparent conductive film constituting the transparent electrode layer 32, for example, a tin oxide film doped with fluorine (FTO film), a zinc oxide film doped with antimony, a zinc oxide film doped with indium, a zinc oxide film doped with aluminum, etc. can be exemplified, in addition to the above-described ITO film. Although the method of forming the transparent electrode layer 32 on the thin film 31 is not particularly limited, for example, a sputtering method, an electron beam method, an ion-plating method, a vacuum evaporation method, or a chemical vapor deposition (CVD) method can be employed.

Next, a method of driving electrophoresis display device 1 will be described.

Figure 2:
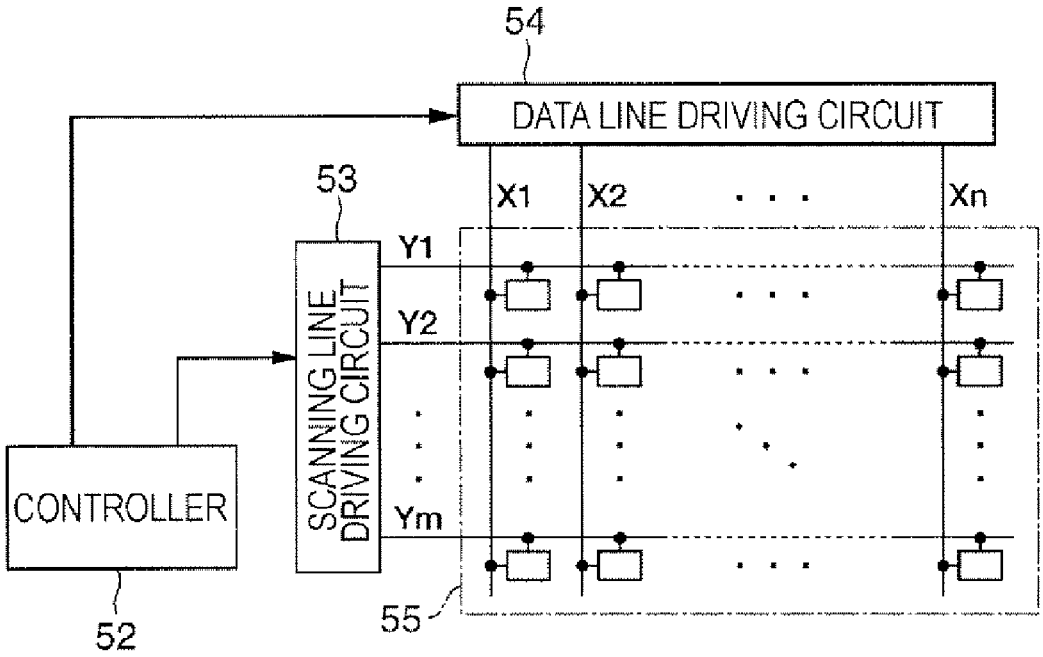
FIG. 2 is a view schematically illustrating the circuit configuration of an electrophoresis display device.

FIG. 2 is a view schematically illustrating the circuit configuration of the electrophoresis display device 1.

A controller (voltage control means) 52 generates image signals showing an image to be displayed in an image display region 55, reset data for performing reset at the time of image rewriting, and other various signals (clock signals, etc.), and outputs them to a scanning line driving circuit 53 or a data line driving circuit 54.

The display region 55 is provided with a plurality of data lines (voltage supply means) arranged parallel to the X-direction, a plurality of scanning lines arranged parallel to the Y-direction, and pixel driving circuits disposed at respective intersections of these data lines and scanning lines.

Figure 3:
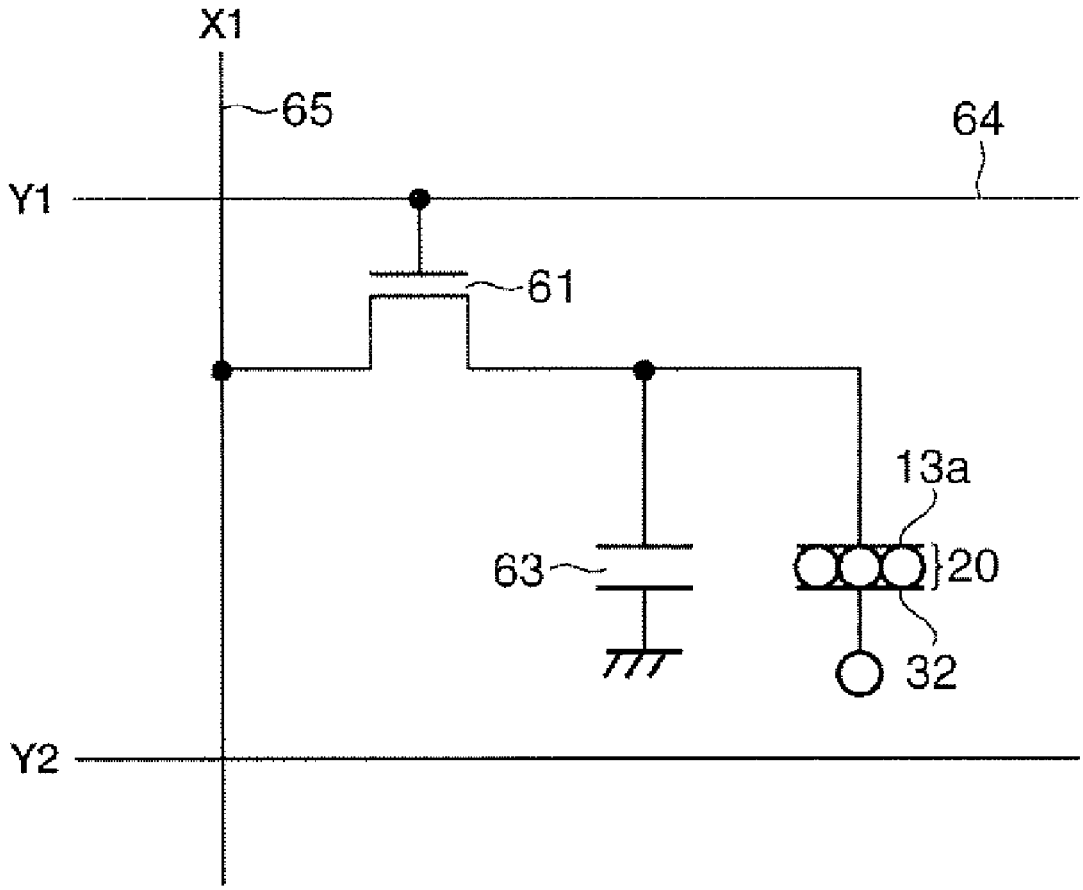
FIG. 3 is a view illustrating the configuration of each pixel driving circuit.

FIG. 3 is a view illustrating the configuration of each pixel driving circuit. In the pixel driving circuit, the gate of a transistor 61 is connected to a scanning line 64, the source thereof is connected to a data line 65, and the drain thereof is connected to the pixel electrode 13*a*. A storage capacitor 63 is connected in parallel with an electrophoretic element. When the data line 65 supplies a voltage to the pixel electrode 13*a* and the transparent electrode layer 32 included in each pixel driving circuit, it makes electrophoretic particles of the electrophoretic layer 20 migrate, performing image display.

The scanning line driving circuit 53 is connected to each scanning line of the display region 55 to select any one of the scanning lines and supply a predetermined scanning line signal Y1, Y2, . . . , or Ym to the selected scanning line. The scanning line signal Y1, Y2, . . . , or Ym is a signal that an active period (H level period) shifts sequentially and this signal is output to each scanning line so that a pixel driving circuit connected to each scanning line may be turned on sequentially.

The data line driving circuit 54 is connected to each data line of the display region 55 to supply a data signal X1, X2, . . . , or Xn to each pixel driving circuit selected by the scanning line driving circuit 53.

Figure 4A:
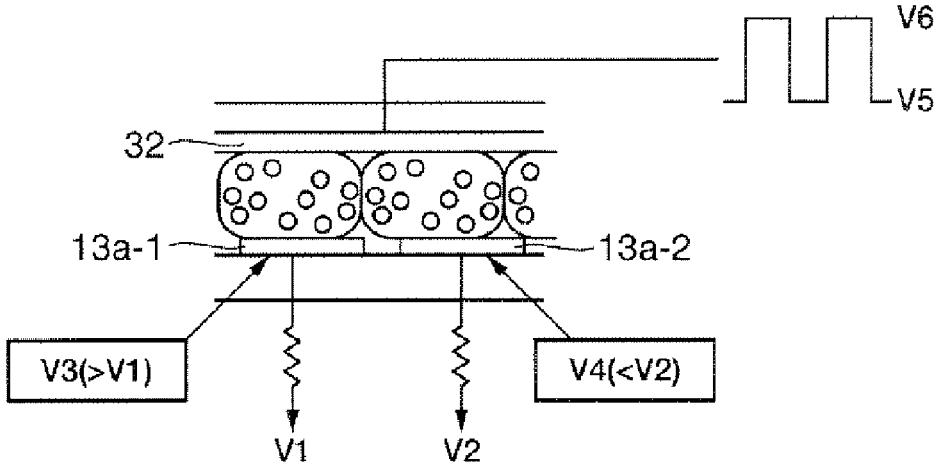
FIG. 4A is a view schematically illustrating voltages applied to a pixel electrode and a transparent electrode of the electrophoresis display device.

FIG. 4A is a view schematically showing voltages to be applied to the pixel electrode 13*a* of the electrophoresis display device 1 and the transparent electrode layer 32 via the data line 65 from the controller 52. Here, V1 and V2 are supplied to pixel electrodes 13*a*-1 and 13*a*-2, respectively, via the data line 65 from the controller 52. In this case, a voltage drop by wiring resistance along the lines, voltage fluctuation by leak, etc. cause the voltages which actually appears in the pixel electrodes 13*a*-1 and 13*a*-2 to shift from V1 and V2 to V3 and V4, respectively.

Here, a case in which V3 is slightly higher than V1 and V4 is slightly lower than V2 will be described. Moreover, the controller 52 applies binary pulse voltages of potentials V5 and V6 to the transparent electrode layer 32. Here, a means to apply a voltage to a pixel electrode, and a means to apply a voltage to a common electrode may be separate.

Figure 4B:
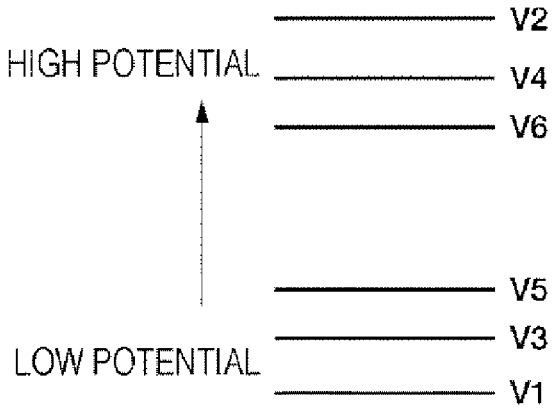
FIG. 4B is a view showing the relationship of respective voltages shown in FIG. 4A.

The relationship among V1 to V6 is shown in FIG. 4B. V5 and V6 are determined in consideration of the wiring resistance on the side of the pixel electrode 13*a* etc. so that they may be set to V5≧V3 and V6≦V4, respectively. Specifically, before the electrophoretic layer 20 is formed, i.e., while the pixel electrode 13*a* is exposed, V1 and V2 may be applied to the pixel electrode 13*a*, and the potentials V3 and V4 which actually appear in the pixel electrode 13*a* at this time may be measured. Otherwise, V3 and V4 may be calculated using the wiring resistance and wiring capacity which are required for the sheet resistivity, length, width, thickness, etc of a wiring pattern.

As described above, generation of an electric field in a direction reverse to a desired direction when the potentials of the pixel electrodes 13*a*-1 and 13*a*-2 shift to V3 and V4 can be prevented by applying binary pulse voltages of the potentials V5 and V6 to the transparent electrode layer 32.

That is, when the potential of the transparent electrode layer 32 is V6, the relationship V6>V3 is satisfied in the region of the pixel electrode 13*a*-1 of the potential V3. Therefore, an electric field is generated in the direction of the pixel electrode 13*a*, and if electrophoretic particles are charged positively, the electrophoretic particles migrate toward the direction of the pixel electrode 13*a*-1. On the other hand, since the relationship V6≦V4 is satisfied in the region of the pixel electrode 13*a*-2 of the potential V4, an electric field is not generated, or even if an electric field is generated, it is generated in the direction of the transparent electrode layer 32. Therefore, electrophoretic particles migrate toward the direction of the transparent electrode layer 32.

Further, when the potential of the transparent electrode layer 32 is V5, the relationship V4>V5 is satisfied in the region of the pixel electrode 13*a*-2 of the potential V4. Therefore, an electric field is generated in the direction of the transparent electrode layer 32, and electrophoretic particles which are charged positively migrate toward the direction of the transparent electrode layer 32. On the other hand, since the relationship V5≧V3 is satisfied in the region of the pixel electrode 13*a*-1 of the potential V3, an electric field is not generated, or even if an electric field is generated, it is generated in the direction of the pixel electrode. Therefore, electrophoretic particles migrate toward the direction of the pixel electrode 13*a*-1.

In this way, electrophoretic particles are prevented from migrating in a direction reverse to a desired direction.

In addition, the substantial duty ratio of a pulse voltage applied to the transparent electrode layer 32 is desirably 50%. This allows uniform application of bipolarity, which makes it possible to prevent deterioration of display unevenness and dispersion liquid.

Further, the period of pulses applied to a common electrode is desirably 50 to 1000 ms. If the period is less than 50 ms, electrophoretic particles cannot response satisfactorily. If the period is not less than 1000 ms, display switching time may become too long.

Although the invention has been described that V3 is slightly higher than V1, and V4 is slightly lower than V2, the invention is not limited thereto. That is, the object of the invention can be achieved if V5 and V6 are set to be VS≧V3 and V6≦V4, respectively, regardless of the hierarchical relation of V1 and V3, and V4 and V2.

In addition, in Embodiment 1, although the electrophoretic layer 20 of the electrophoresis display device 1 includes a plurality of microcapsules 21, even if the electrophoretic layer 20 does not include the microcapsules 21, it needs only to be a layer formed of an electrophoretic dispersion liquid containing electrophoretic particles.

Further, in Embodiment 1, the pixel electrode group is arranged in a matrix to form the active matrix circuit, arrangement of the pixel electrode group is not limited thereto.

Electronic Apparatus

Figure 5A:
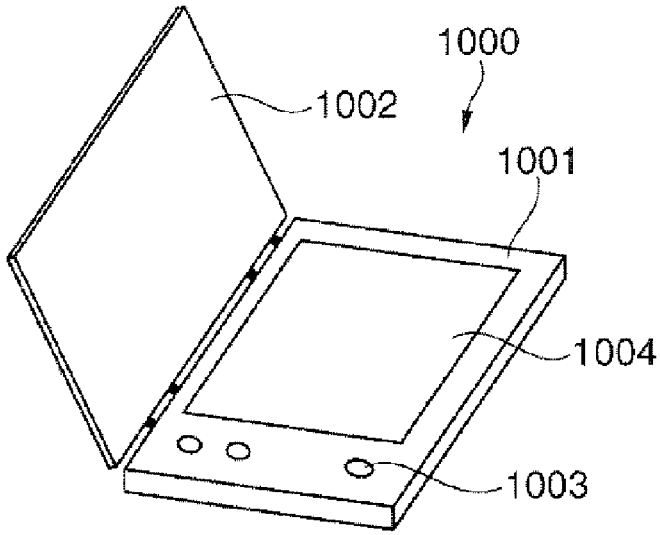
FIGS. 5A to 5C are views illustrating concrete examples of electronic apparatuses to which the electrophoresis device of the invention is applied.

FIG. 5 is a perspective view illustrating concrete examples of electronic apparatuses to which the electrophoresis device of the invention is applied. FIG. 5A is a perspective view showing an electronic book that is an example of an electronic apparatus. This electronic book 1000 includes a book-shaped frame 1001, an (openable and closable) cover 1002 rotatably provided with respect to the frame 1001, an operation unit 1003, and a display unit 1004 composed of the electrophoresis device according to the present embodiment.

Figure 5B:
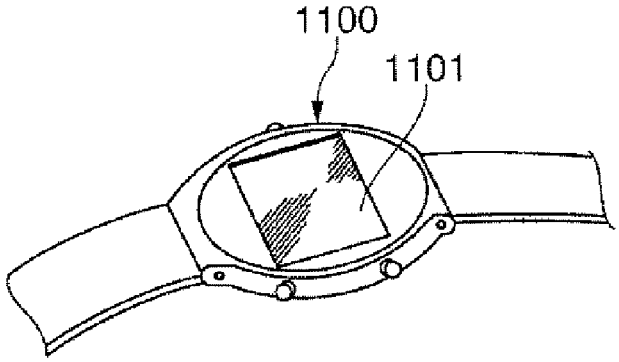

FIG. 5B is a perspective view showing a wrist watch that is an example of an electronic apparatus. This wrist watch 1100 includes a display unit 1101 composed of the electrophoresis device according to the present embodiment.

Figure 5C:
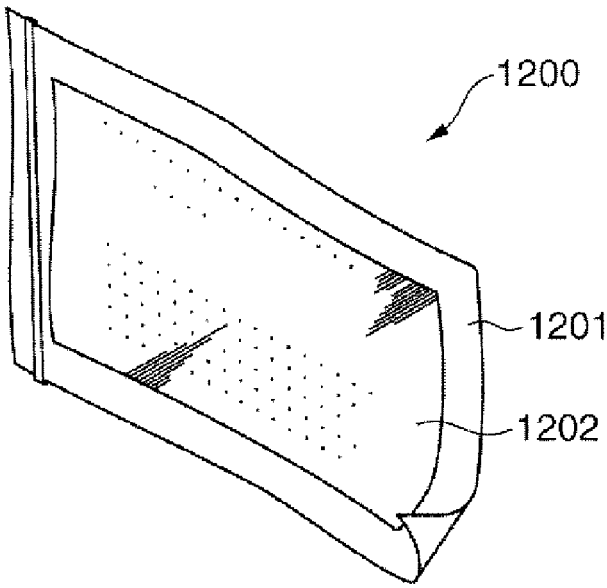

FIG. 5C is a perspective view showing an electronic paper that is an example of an electronic apparatus. This electronic paper 1200 is made of rewritable sheets having the same texture and flexibility as paper. The electronic paper includes a main body 1201, and a display unit 1202 composed of the electrophoresis device according to the present embodiment. In addition, the electronic apparatuses to which the electrophoresis device can be applied are not limited thereto, but widely include apparatuses utilizing changes in a visual tone accompanying migration of charged particles. For example, the electronic apparatuses also involves things belonging to real estate, such as wall surfaces to which an electrophoretic film is bonded, and things belonging to movable bodies, such vehicles, flying bodies, and vessels, in addition to the apparatuses as described above.

The entire disclosure of Japanese Patent Application No. 2005-276543, filed Sep. 22, 2005 is expressly incorporated by reference herein.

What is claimed is:

1. An electrophoresis device which includes:

a first substrate having a plurality of pixel electrodes formed on a surface thereof, a second substrate having a common electrode formed on a surface thereof and disposed to face the pixel electrodes, and an electrophoretic layer disposed between the pixel electrodes and the common electrode, and which makes electrophoretic particles migrate by keeping the potential of each pixel electrode constant and changing a voltage to be applied to the common electrode, the device comprising:

a voltage control means which supplies first and second voltages V1 and V2 to the pixel electrodes, and in response to the first and second voltages V1 and V2 shifting to third and fourth voltages V3 and V4, respectively, supplies a voltage pulse that varies between fifth and sixth voltages V5 and V6 to the common electrode, wherein V1<V3<V5 and V6<V4<V2.

2. The electrophoresis device according to claim 1, wherein the first substrate further comprises a thin film semiconductor circuitry layer.

3. An electronic apparatus comprising the electrophoresis device according to claim 1.

4. A method of driving an electrophoresis device which includes:

a first substrate having a plurality of pixel electrodes formed on a surface thereof, a second translucent substrate having a common electrode formed on a surface thereof and disposed to face the pixel electrodes, and an electrophoretic layer disposed between the pixel electrodes and the common electrode, and which makes electrophoretic particles migrate by keeping the potential of each pixel electrode constant and changing a voltage to be applied to the common electrode, the method comprising:

supplying first and second voltages V1 and V2 to the pixel electrodes, and in response to the first and second voltages V1 and V2 shifting to third and fourth voltages V3 and V4, respectively, supplying a voltage pulse that varies between fifth and sixth voltages V5 and V6 to the common electrode, wherein V1<V3<V5 and V6<V4<V2.

5. The method of driving an electrophoresis device according to claim 4, wherein the voltage to be applied to the common electrode is a pulse voltage of 50% duty ratio.

6. The method of method an electrophoresis device according to claim 4, wherein the voltage to be applied to the common electrode is changed at a pulse period of 50 to 1000 milliseconds.

* * * * *